US005918687A

United States Patent [19]

Prater, Jr. et al.

[11] Patent Number: 5,918,687

[45] Date of Patent: Jul. 6, 1999

[54] SMALL DIAMETER IMPACT BORING TOOL

[75] Inventors: Glen Prater, Jr., Crestwood, Ky.; William P. Hnat, Floyds Knob, Ind.; Robert L. Collins; Songnian Wang, both of Louisville, Ky.

[73] Assignee: Columbia Gas Distribution Companies, Columbus, Ohio

[21] Appl. No.: 09/110,780

[22] Filed: Jul. 6, 1998

Related U.S. Application Data

[62] Division of application No. 08/788,226, Jan. 27, 1997, Pat. No. 5,816,342.

[51] Int. Cl.[6] ..... E21B 4/14

[52] U.S. Cl. ..... 173/91; 173/206; 175/19; 175/296

[58] Field of Search ..... 173/91, 206, 17, 173/135, 200, 73, 80; 175/19, 296

[56] References Cited

U.S. PATENT DOCUMENTS 4,114,950 9/1978 Cooper .
4,618,007 10/1986 Kayes .
4,840,237 6/1989 Roemer .
4,886,128 12/1989 Roemer .
5,056,608 10/1991 Hemmings .
5,210,918 5/1993 Wozniak et al. .
5,226,487 7/1993 Spektor .
5,413,185 5/1995 Kayes .
5,505,270 4/1996 Wentworth .
5,511,626 4/1996 Steen ..... 173/91
5,787,995 8/1998 Ekwall et al. ..... 173/91

*Primary Examiner*—Scott A. Smith
*Attorney, Agent, or Firm*—Kremblas, Foster, Millard & Pollick

[57] ABSTRACT

An elongated tube has a high pressure feed line on one end and an impact head on the other end. A tube intermediate the ends of the tool houses two cylinders having one piston is in each cylinder. The two pistons are tied together by a piston rod extending through a bulkhead dividing the two coaxially aligned cylinders.

12 Claims, 3 Drawing Sheets

SMALL DIAMETER IMPACT BORING TOOL

CROSS REFERENCE TO RELATED APPLICATION

This application is a divisional of U.S. Ser. No. 08/788,226 filed Jan. 27, 1997, now U.S. Pat. No. 5,816,342

FIELD OF THE INVENTION

This invention relates to a small diameter elongated impact boring tool which uses two axially aligned cylinders to house two pistons. The two pistons are tied together with an elongated piston rod to provide a tandem set of pistons in the impact body for driving the tool through soil.

BACKGROUND OF THE INVENTION

Pneumatically operated impact-action self-propelled tools for driving holes in soil are not new. The need for boring holes in soil for relatively short distances, about fifty feet or so, to allow a hose or pipe to pass beneath a road, a sidewalk or railroad track without extensive excavation has long been a problem. Obviously, one could dig a tunnel using conventional apparatus at relatively high cost, but often that is not practical.

Small diameter tools having an impact head on one end of a tube and a power source of pneumatic fluid on the other end have long been a solution. One example is a patent to Kayes, U.S. Pat. No. 4,618,007, which shows a reciprocal piston in a housing structure to deliver impacts to an anvil member and drive the tool forward. A central passage for delivering a continuous supply of compressed air into the rear chamber of a sleeve provides the motive power for driving the tool forward.

A patent to Roemer, U.S. Pat. No. 4,840,237, discloses a ram boring implement having a pneumatically driven percussion piston (16), which is movable in the axial direction in a reciprocating manner in a housing (12). A control sleeve (24) is axially adjustable for reversing the direction of motion of the ram boring implement and is acted upon by the pressure in one (20) of the pressure chambers (18, 20) formed on both sides of the percussion piston (16). The control sleeve (24) can be adjusted by means of a spindle drive (30, 50) by turning a compressed air supply hose (26). According to the invention, the control sleeve is arranged on a core (30, 34) supported in an axially fixed manner on the housing (12), so that the control sleeve itself forms only a relatively small annular effective area (52) acted upon by pneumatic pressure. This makes it possible for the control sleeve to be moved forward or rearwardly without the compressed air feed having to be interrupted. A second patent to Roemer, U.S. Pat. No. 4,886,128, discloses a ram boring implement having a pneumatically or hydraulically driven percussion piston. The piston is movable axially in a reciprocating manner within a housing and an axially movable bit is connected to an end of the housing to be acted upon directly or indirectly by the percussion piston. The structure permits a restoring piston connected to the bit to be acted upon by the pneumatic or hydraulic pressure during the return stroke of the percussion piston.

A patent to Spektor, U.S. Pat. No. 5,226,487, discloses the history of boring tools of the kind using pneumatic fluid and an impact head in some detail beginning in column 3, line 44 and extending through column 5, line 17. Longitudinally extending lines or passages for bleed air and feed air are shown in FIGS. 3 and 4. The passages are formed by machining grooves in the surface of a cylindrical tube and then sliding a cover over the grooved passage to form a sealed, small diameter air passage. The overall disclosure of the patent is not substantially different from the patents discussed herein to Kayes and Roemer.

A second patent to Kayes, U.S. Pat. No. 5,413,185, discloses a pneumatically operated impact-action self-propelled mechanism for driving holes in the earth, comprising a cylindrical housing assembly (1) with an anvil member (2) located at a forward end thereof and a pneumatically-operated impact piston (3) reciprocating in the housing to deliver successive impacts to the anvil member (2). The housing is formed with a forward chamber (6) of variable volume. The mechanism includes a lead chamber (22) forward of the anvil member (2). A lead piston (23) reciprocal in the lead chamber (22) and is connected at its forward end to the head (24) of the mechanism. Compressed air supply member (29, 30) communicates between the forward chamber (6) and the lead chamber (22) to the rear of the lead piston (23) so as to cause the lead piston to travel forward.

One of the problems with the prior art as exemplified by these patents is the size of the tool used. The relatively short tool body and large cylinder diameter allows the advancing head to be deflected transversely upon impacting rocks, roots and the like. That is, the larger diameter inherently encounters a greater cross-sectional area than a small diameter. Existing impact tools have no accessories which tell the equipment operators that the tools have been deflected from the desired alignment.

Since a hose or other hollow feed line follows and feeds the tool as it advances through the soil, the feed line must be kept free from obstructions such that it can provide a good feed to the trailing end of the impact tool. Unfortunately, cylindrical tools such as described above in the prior art tend to rotate about a horizontal axis for reasons which have to do with the texture of the soil being penetrated and other physical characteristics. Rotating the tool obviously causes the trailing air supply hose to twist which may impair the uniform feed of air to the tool. Further, where rotation of the feed line is used to reverse direction of the tool to withdraw it from the hole, the twisting tool may inadvertently trigger a reversal.

Reverse movement of the impact piston also tends to draw the tool rearwardly and may kink the feed hose. The obvious disadvantages are two fold. One is cutting off of the maximum feed by the hose; the other is that the retraction of the tool upon impact of the piston in its return stroke move the tool away from the front of the hole being drilled. Thus, the next advance stroke or next impact of the drive piston requires the tool to partially retrace its path from the previous impact.

SUMMARY OF THE INVENTION

This invention solves the retraction problem by providing an elongated tube of relatively small cross-sectional area between the impact head on the front of the tool and the hose connections at the rear of the tube. The elongated tube houses two separated cylinders, each having its own impact piston therein. The two cylinders are divided by an intermediate bronze split bulkhead and the two pistons are tied together by a piston rod which connects to each piston and projects through a hole in the bulkhead. The long narrow tube supporting the tandem pistons creates a large surface area at the exterior of the tool and thereby maintains a relatively large friction surface to minimize the retrograde movement upon the retraction of the tandem pistons.

In order to minimize the retraction impact of the pistons at the valving and hose connections at the rear of the tool body (and to prevent the retraction of the tool from the hole already drilled), exhaust air during the retraction of the pistons is forced to go through a choke hole or plate before being exhausted to the atmosphere through the trailing end of the tool. Because of this choke inserted into the exhaust path, the air on the trailing side of each cylinder tends to act as a buffer or cushion for the pistons in their return stroke. Inherent in the buffer concept is that the return stroke is slower than the advance stroke.

The small cross-sectional area achieved by the design described herein yields several benefits, namely,:

1. Decreased soil displacement volume, thereby reducing heaving and possible damage to surface structure such as pavement and sidewalks and further reducing damage which might result from future soil subsidence where the initial hole is not completely filled by the tube being installed;
2. Smaller soil bearing forces which leads to higher boring rates and/or lower input power requirements; and
3. Reduced weight of the equipment, thereby simplifying handling, installation and removal by the operating personnel.

The tandem piston concept has been used in steam engines and the like for a hundred years or so. However, the concept of tandem pistons in a boring tool of this inventive concept is not in the prior art. The tandem piston concept as implemented herein increases the net pressure force on the rod assembly while maintaining the desired small cross-sectional area. This leads directly to greater impact forces at the end of the advance stroke. In addition, the length of the stroke is effectively halved because there are two pistons. The reduced stroke length significantly increases the piston cycle rate. An increased boring speed is therefore possible.

The structure of this invention essentially comprises a cylindrical tube inside a rectangular tube and the air passages for feeding and exhausting air from the cylinders within the cylindrical tube all pass through the corner sections of the square duct just exterior of the cylindrical tube. Placing the air passages outside the cylindrical bore avoids any reduction in the effective piston area and insures against any decrease in structural stability which might result if grooves are cut in the exterior surface of the cylindrical duct. The square exterior structure has the additional beneficial effect of increasing the stiffness of the elongated body and helping to prevent deflections due to the impact head encountering rocks or soil of varying density.

A control valve on the trailing end of the tool comprises a longitudinally oscillating spool which cyclically regulates the flow of air to the pistons in the tool.

Objects of the invention not clear from the above will be fully understood upon a review of the drawings in combination with the description of the preferred embodiment which follows.

DESCRIPTION OF THE PREFERRED EMBODIMENTS

Figure 1:
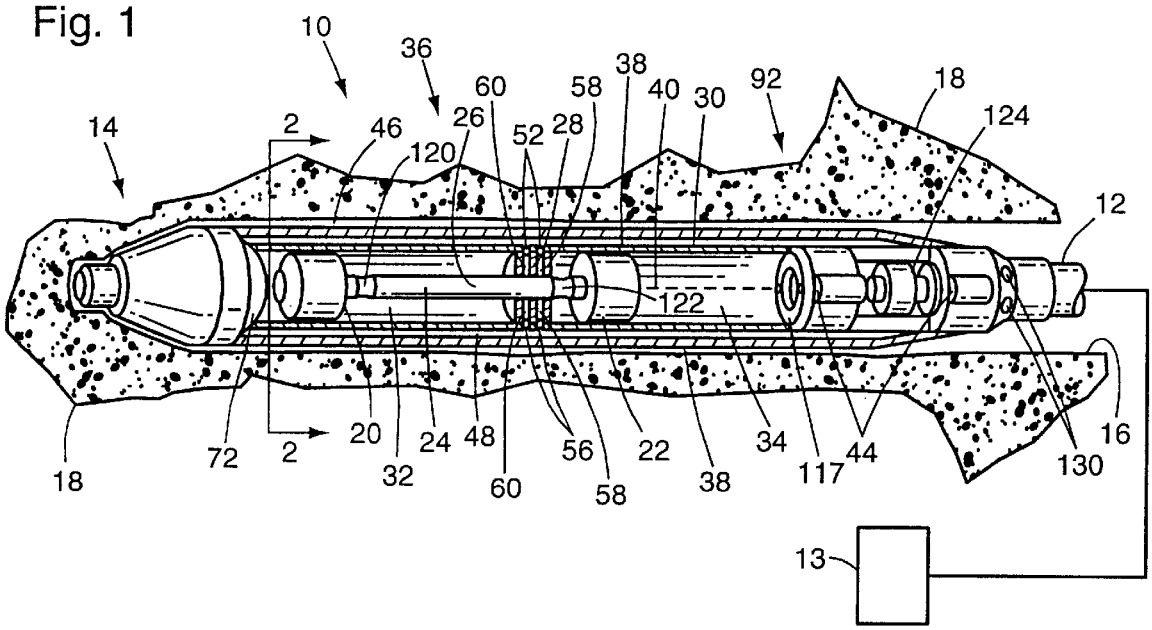
FIG. 1 is a perspective view of the tool of this invention, partially in section.

Looking to FIG. 1 it will be observed that a small diameter, pneumatically driven impact tool 10 includes a hose or other hollow feed line 12 trailing behind the tool and an impact head 14 on the front end. Hose 12 is connected to a pressurized fluid supply 13, which is preferably an air compressor. The tool 10 is illustrated as forming a hole 16 in a soil bank 18. Note that the piston and cylinder combination includes two pistons 20, 22 mounted on a single piston rod 24 which extends through an aperture 26 in a bulkhead 28 which divides a cylindrical support tube 30 into forward and rear cylinders 32, 34, respectively. Bulkhead 28 should be placed such that forward and rear cylinders 32, 34 are about equal in length. Piston rod 24 should be coaxial with forward and rear cylinders 32, 34. In the preferred embodiment, the diameter of the cylinders should be less than about 1/50 the length of the cylindrical support tube 30.

The use of tandem pistons as illustrated allows the net pressure force or momentum to be nearly doubled compared with a single piston of equivalent cross-sectional area. This in turn greatly decreases the boring tool's frontal area, with a corresponding reduction in the energy required to cleave and compact the soil 18 at the tip of the impact head 14. The resulting higher pressure forces and shorter stroke increase the cycle frequency; and separate supply and exhaust paths for the pneumatic fluid driving each piston increases overall flow capacity as will be explained subsequently. The tandem piston arrangement is one of the most innovative features in the design and appears to be unique among boring tools. In addition, the pistons may be provided with piston rings of conventional design (not shown) to decrease the loss of air around the pistons. The piston rings are preferably made of TEFLON® but may be any kind well-known in the art.

Figure 2:
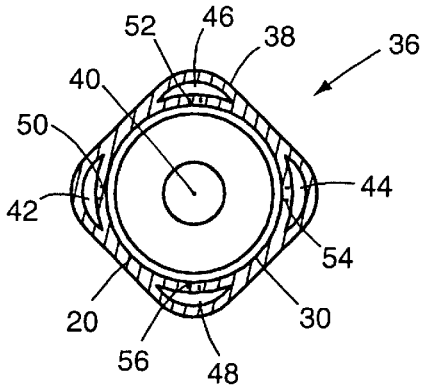
FIG. 2 is a sectional view taken along line 2—2 of FIG. 1.

FIG. 2 shows the main tube or body 36 of the tool which shows the cylindrical tube 30 surrounded by or encompassed within a square tube 38. While such a shape increases the hydraulic diameter, the increase is less than expected from expanding the diameter of a circular body to accommodate internal air passages. The square cross-section also minimizes the tendency of the tool to rotate about its longitudinal axis 40. Rotation about its longitudinal axis in its progression through soil 18 leaves residual torsional stresses in the distribution line 12 after installation or could kink the line 12 during the boring operation. Further, relative rotation between the feed line 12 and tool body 36 could inadvertently switch the tool to its withdrawal mode and accidentally retract the tool from the hole 16.

A multiple piece weldment is a preferred fabrication method for the body 36, but the exact means for fabrication may be modified by those having ordinary skill in the art without departing from the spirit of the invention.

The illustrated cross-sectional shape of FIG. 2 shows the squared exterior tube 38 as having rounded corners. Square corners are certainly within the concept of the invention, but rounded corners are preferred.

Each corner defines an air passage 42, 44, 46, 48 in the space between the corner surface and the exterior surface of cylindrical tube 30. Diagonally spaced air passages 46, 48 carry bleed air and diagonally spaced passages 42, 44 carry high pressure feed air as will be explained subsequently. Each of the passages 42, 44, 46, 48 is periodically in fluid communication with air inside one of the cylinders 32, 34 as illustrated in phantom by passages 50, 52, 54, 56 in FIG. 2.

Bleed air ports 52, 56 are schematically illustrated in FIG. 2, but are more fully understood by an observation of bulkhead 28 in FIG. 1. To facilitate assembly, bulkhead 28 is formed of two bronze halves secured together around piston rod 24 before the tandem piston assembly is inserted into cylindrical tube 30 and before cylindrical tube 30 is assembled within square tube 38. Note that bulkhead 28 has two sets of diagonally oppositely directed passages 58, 60 which will be explained in detail subsequently where the operation of the tool is described.

Figure 3:
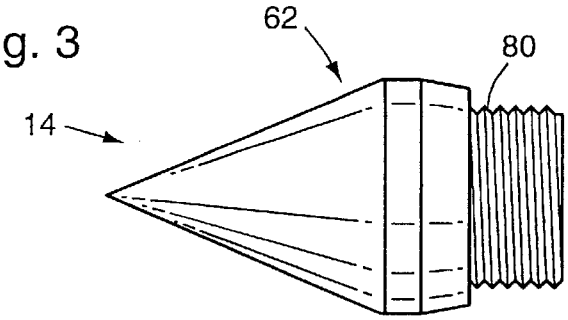
FIGS. 3–6 show various impact heads useful in this invention.

Looking now to FIGS. 3–6, four separate impact heads 14 are illustrated. It is within the inventive concept to have different shapes and operations of the impact heads for diverse operations. The conical head 62 of FIG. 3 is found to work best in sandy soil.

Figure 4:
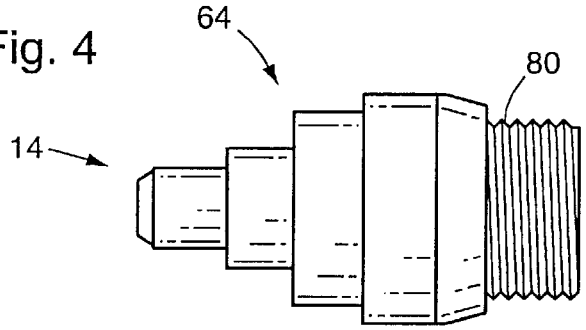

The impact head 64 illustrated in FIG. 4 shows a solid metal head which includes a face with a plurality of cylindrical surfaces of decreasing diameter forwardly from the tube 36. This stepped head of FIG. 4 operates best in clay based soils.

Figure 5:
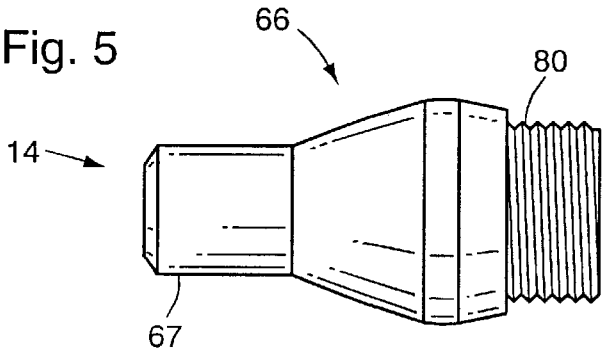

A hybrid head 66 illustrated in FIG. 5 has a frustroconical front face converging forwardly toward a cylinder 67 projecting forwardly.

Figure 6:
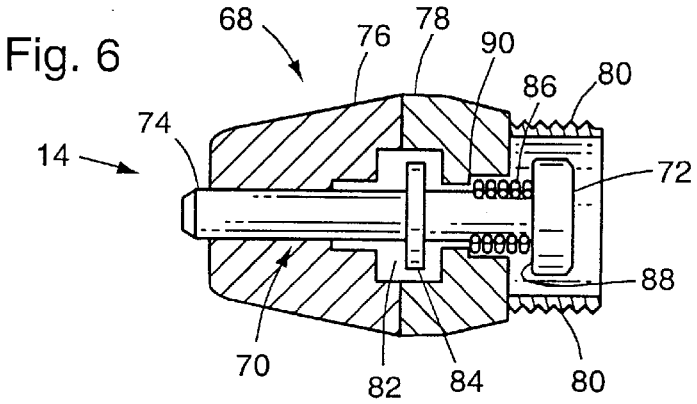

FIG. 6 shows an additional or modified multi-piece piercing rod head 68. The head comprises a housing which allows a piercing rod 70 to reciprocate longitudinally during normal operations. Rod 70 includes an anvil 72 on its trailing end for engagement with the forward piston 20 when forward piston 20 is being driven toward the impact head. The rod 70 includes a forwardly extending prong 74 mounted to reciprocate between an extended position and a retracted position. FIG. 6 illustrates the retracted position where the forwardmost portion of prong 74 is withdrawn and almost coextensive with the front face of the housing. The housing itself includes a forward section 76 having a forwardly converging frustroconical face. A rear section 78 is connected to the forward section and to the tube 36 in conventional fashion. Threads 80 are illustrated as one way of making the connection, but others will come to mind and are within the inventive concept.

A chamber 82 is shown being formed by cavities in the forward and rear sections 76, 78 to encompass a radially extending flange 84 projecting from rod 70. The chamber 82 and flange 84 are assembled in this fashion to maintain the rod within the housing. It is clear that the chamber 82 could be formed in either the forward or rear section of the housing instead of partially in each if desired.

A coil spring 86 circumscribes the rod 70 and abuts a shoulder 88 on the forward face of anvil 72 and another shoulder 90 on the rear section 78. Spring 86 serves to bias rod 70 to a retracted position to receive the next impact during normal operations of the equipment.

Figure 7:
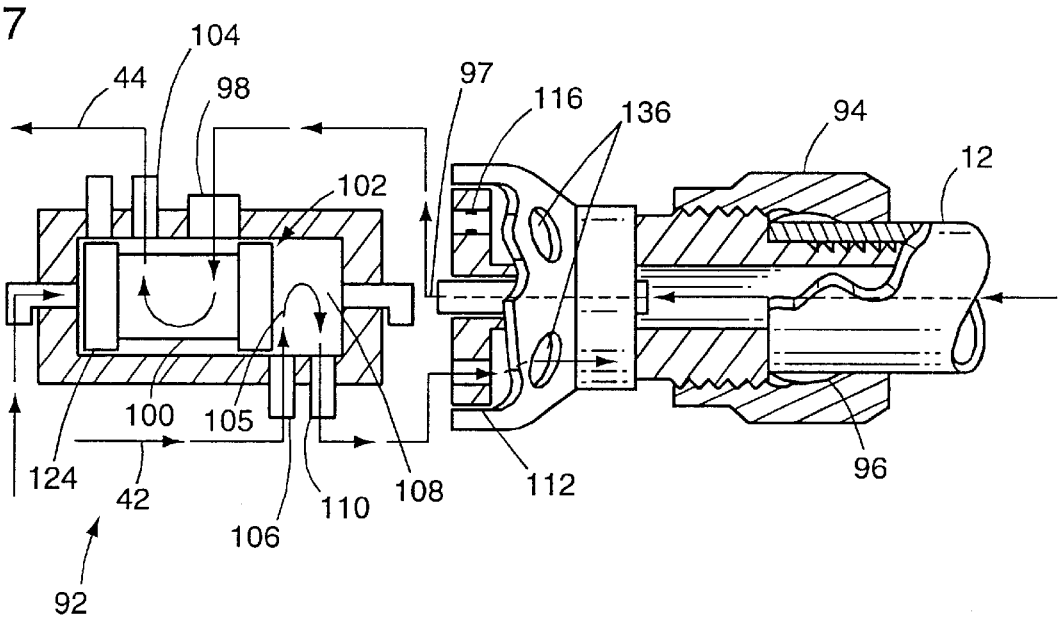
FIG. 7 is a fragmentary schematic view partially in section of the trailing end of the tool of this invention illustrating the flow direction of feed air.
Figure 8:
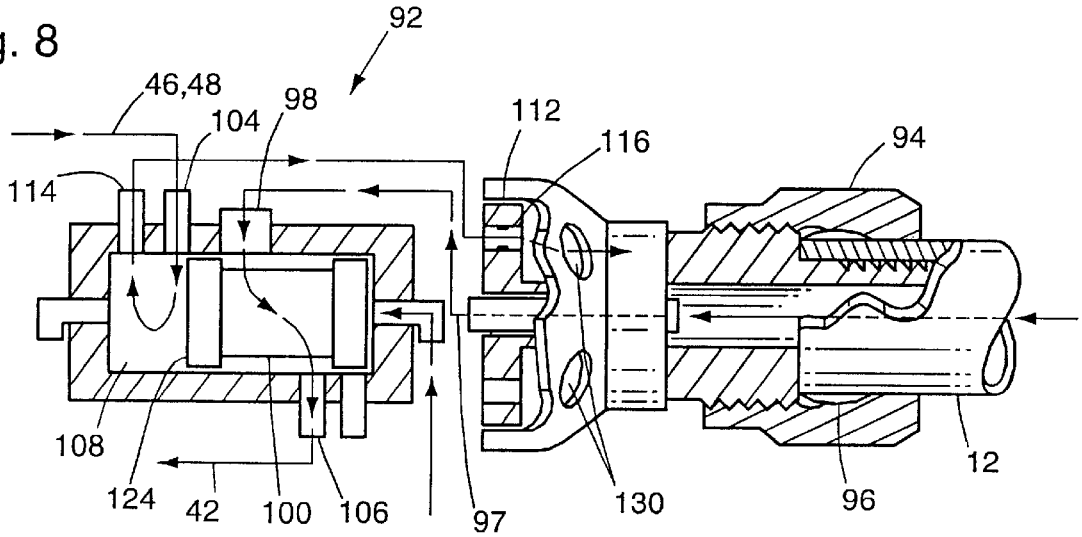
FIG. 8 is a view similar to FIG. 7, but with the flow path for the exhaust air being illustrated.

Looking now to the schematic illustrations of the control valve system on the trailing end of the tool, FIGS. 7 and 8, a spool valve 92 controls the flow of feed air, exhaust air and bleed air from high pressure feed line 12. In normal operations it is anticipated that feed line 12 will become the gas supply line to be used in subsequent operations after it is dragged through the hole 16 formed by the tool. In such instances feed line 12 is formed of polyethylene. The hose connection to the tool will be somewhat deformed in its mounting on the trailing end of the tool by the nut 94 and compression ring 96. Preferably, after the hole 16 is completed the hose 12 will be disengaged from the tool and the forward portion severed before it is connected to the supply duct for delivering gas or other fluids to another destination. The end of hose 12 which was connected to pressurized fluid supply 13 may be reconnected to any other source.

Note in FIG. 7 that high pressure air passes through passage 97 to an inlet 98 to pass through the grove 100 in spool valve structure 102 and out through outlet 104. Outlet 104 is in fluid communication with either passage 42 or 44 formed in one corner of square tube 38. While this is taking place exhaust air from the other of line 42 or 44 passes from the forward portion of the tool through port 106 into chamber 108 and out though port 110 to an orifice plate 112. Air passing through the plate 112 exhausts into the drilled hole 16 and ultimately to the atmosphere.

FIG. 8 illustrates the spool valve in retracted position such that bleed air from passages 46, 48 passes into the forward portion of chamber 108 through port 104 and out through port 114 to orifice plate 112. Note that the metered discharge port 116 through orifice plate 112 for the bleed air is choked to a smaller cross-sectional area and the purpose is to provide an air cushion to minimize the piston 22 impact against donut shaped target 117 (best seen in FIG. 1) upon retraction of the tandem piston arrangement and to minimize the retrograde movement of the tool inherent in such operations. The high pressure feed air from line 12 enters the valving structure through port 98 and passes through the cavity 100 in the sliding spool valve 124 and out through port 106 to feed line 42.

In operation the tool 10 is moved by hand operation to an entrance site where a hole is desirable, probably beneath a paved structure of some kind on the surface. Creation and control of oscillatory piston motion is perhaps the most important feature of this design and it is accomplished through the use of a control system consisting of a two position, pilot actuated spool valve, having four longitudinal air passages along the tool. A tandem piston rod assembly having two circumferential grooves 120, 122 in piston rod 24, best seen in FIG. 1, allows the operation to precede as described. One of the four air passages 42 supplies the cylinders 32, 34 at the start, one passage 44 exhausts the cylinders and the others 46, 48 discharge bleed air to the ends of the control valve spool 124 to adjust it into the desired position. Note that each of the two circumferential grooves 120, 122 is near one of the pistons 20, 22, respectively.

The control system layout illustrated schematically in FIGS. 7 and 8 includes six ports in the cylindrical tube 30 to operate as follows:

1. The first port supplies high pressure air in line 44 to the aft cylinder 34 during the advance stroke and exhausts air on the return stroke;
2. A second port supplies air from the same passage 44 to the forward cylinder 32 through another port during the advance stroke and exhausts it on the return stroke;
3. A third port exhausts air from the aft cylinder 34 in front of the aft piston 22 during the advance stroke into exhaust passage 42 and supplies high pressure air to the cylinder during the return stroke;
4. A fourth port exhausts air in the forward cylinder forward of the forward piston 20 during the advance stroke to passage 42 and supplies high pressure air to the same location in the return stroke;
5. A fifth port 52 allows air to flow from one longitudinal air passage to another when the aft piston groove 122 is aligned with a bleed hole 56 which is drilled transversely through the bulkhead; and
6. A sixth port allows air to flow between the longitudinal air passages 46, 48 when the forward rod groove 120 is aligned with a second bleed hole 58, also drilled transversely through the bulkhead.

As the tandem piston begins to advance, high pressure air is routed to the cylinders 32, 34 behind the two pistons 20, 22 through the first and second ports identified above, moving the entire tandem piston/rod assembly forward. Exhaust air from the cylinders in front of the two pistons is routed through the third and fourth ports identified above to a control valve chamber, see FIGS. 7 and 8, that discharges it behind the tool through the ports 130. At the end of the advance stroke piston 20 strikes anvil 72, the aft rod groove 122 aligns with the aft bleed hole 56 and passage 58, thereby allowing high pressure bleed air to flow to the main control valve 92 and shift its spool 124. This movement switches the direction of air flow, which initiates the return stroke. When the return stroke is complete the forward rod groove 120 aligns with the forward bleed hole 60 and the control valve spool 124 again shifts and a new advance stroke begins. Thus, sustained, self-regulating oscillation of the tandem piston combination is maintained.

As the piston advances in the procedure described above there is a tendency of the tool to move rearwardly so that the system center of mass remains fixed. This retrograde motion is prevented by the static friction force of the soil that exists as the body 36 comes to rest after a forward displacement increment. There is also a tendency for retrograde motion when the piston assembly is reversed at the end of the return stroke. This later problem is prevented by controlling the direct impact with a cushion chamber created by differential metering at the spool valve exhaust ports 116.

Use of differential metered cushion chambers allows reversal of the boring tool's direction of travel. During normal operation the exhaust flow from the first and second port are metered during the return stroke; the exhaust through the third and fourth ports during the advance stroke is not restricted. During reversal, exhaust through the third and fourth ports is metered; that through the first and second ports is not restricted.

Should there be a desire to stop the forward advance of tool 10 and remove it from hole 16, the operator must reverse the operating sequence of the pistons 20, 22. That is, the piston 22 must become the driving force by impacting rear anvil 117 and the buffered exhaust gas must cushion the impact of piston 20 on anvil 72 as the tandem pistons move from right to left as shown in FIG. 1. This is accomplished by rotating orifice plate 112 to reorient the flow of exhaust gas from the cylinders through choke 116 during piston movement from right to left.

In this invention a detent (not shown) is provided to hold the orifice plate 112 in one operative position. The hold of the detent may be overcome by a manual-mechanical rotation of feed line 12 through an angle of about 90°. This reverses the air flow patterns in the tool 10 and the tool may be withdrawn from the hole 16 by manual pulling of feed line 12, further assisted by the reversal of impacts of the tandem piston combination.

In the preferred embodiment the tool incorporated a cylindrical tube of about one inch outside diameter and the square tube measured a little over about one and one-eighth inches between the corners of the intersection of straight lines along the flat sides. The tube 38 has a longitudinal length in the range between about 30 and at least about 50 times the distances between adjacent corners of the square.

It will be appreciated that the orifice plate 112 illustrated schematically in FIGS. 7 and 8 is easily replaceable by any functionally equivalent structure which may be reoriented by rotation of the feed line 12. One such structure might be a hollow, axially extending pin with radially extending ports to receive exhaust air. One of the ports would have a choke 116.

Having described the invention in its preferred embodiment, it will be clear to those having ordinary skill in the art that modifications may be made to the structure or procedural sequence of the disclosed invention without departing from the spirit thereof. It is not intended that the drawings or the language used in describing the invention be limiting thereon. Rather it is intended that the invention be limited only by the scope of the appended claims.

We claim:

1. Apparatus for forming a hole in soil comprising, a tube of generally square exterior cross-section having four corners;

an impact head mounted on one end of said tube;

a hollow line secured to an opposite end of said tube;

a cylindrical bore in said tube, a bulkhead dividing said bore into a leading cylinder and an aft cylinder, said cylinders being of about equal length;

a piston rod mounted coaxially within said bore and extending through a hole in said bulkhead, a forward piston being secured to said rod in said leading cylinder and an aft piston being secured to said rod in said aft cylinder, a valve mounted on said tube between said aft cylinder and said hollow line to control the flow of fluid from said hollow line to said cylinders and from said cylinders back through said valve into the atmosphere, four passages for said fluid formed in said tube and radially outward of said cylinders, one passage being located in each of said corners, said rod and said two pistons being mounted to reciprocate longitudinally in said cylinders in response to fluid supplied from said hollow line through said valve and said passages, and an anvil on a trailing end of said impact head, said anvil forming a forward end of said leading cylinder and serving to receive impacts from said forward piston to drive said impact head forward.

2. The apparatus of claim 1 wherein said tube has a longitudinal length at least about 50 times distances between adjacent corners to thereby minimize deflection of said tube from a linear path during operation.

3. The apparatus of claim 2 and further comprising a meter to slow the discharge of fluid and reduce retrograde movement of said tube.

4. The apparatus of claim 3 wherein said impact head includes a piercing rod mounted in a housing to reciprocate longitudinally in said housing, said piercing rod including (1) said anvil and (2) a forwardly extending prong mounted to reciprocate in said housing between an extended position and a retracted position, said housing having a forward section and a rear section, said rear section being connected to said tube, said forward section including a rearwardly diverging face to engage and deflect soil as said apparatus moves forwardly, said prong being axially moveable from a position projecting forwardly of said face in extended position and substantially retracted into said housing in retracted position.

5. The apparatus of claim 3 wherein said impact head includes a conical front face.

6. The apparatus of claim 3 wherein said impact head is of solid metal and includes a face with a plurality of cylindrical surfaces of decreasing diameter forwardly from said tube.

7. The apparatus of claim 3 wherein said impact head includes a face with a frustoconical surface converging forwardly to a cylindrical forwardly extending projection.

8. The apparatus of claim 1 and further comprising a meter to slow the discharge of fluid and reduce retrograde movement of said tube.

9. The apparatus of claim 1 wherein said impact head includes a piercing rod mounted in a housing to reciprocate longitudinally in said housing, said piercing rod including (1) said anvil and (2) a forwardly extending prong mounted to reciprocate in said housing between an extended position and a retracted position, said housing having a forward section and a rear section, said rear section being connected to said tube, said forward section including a rearwardly diverging face to engage and deflect soil as said apparatus moves forwardly, said prong being axially movable from a position projecting forwardly of said face in extended position and substantially retracted into said housing in retracted position.

10. The apparatus of claim 1 wherein said impact head includes a conical front face.

11. The apparatus of claim 1 wherein said impact head is of solid metal and includes a face with a plurality of cylindrical surfaces of decreasing diameter forwardly form said tube.

12. The apparatus of claim 1 wherein said impact head includes a face with a frustoconical surface converging forwardly to a cylindrical forwardly extending projection.

* * * * *